United States Patent [19]

Bals

[11] 4,222,523

[45] Sep. 16, 1980

[54] TURBINE DRIVEN ROTARY ATOMIZER AND METHOD OF USE

[75] Inventor: Edward J. Bals, Bromyard, England

[73] Assignee: Pennbrook Corporation, Far Hills, N.J.

[21] Appl. No.: 942,157

[22] Filed: Sep. 14, 1978

[51] Int. Cl.[2] ..... B05B 3/02

[52] U.S. Cl. ..... 239/216; 239/223; 239/381

[58] Field of Search ..... 239/214, 216, 223, 381

[56] References Cited

U.S. PATENT DOCUMENTS

| | | | |
|---|---|---|---|
| 2,901,177 | 8/1959 | Norris | 239/223 X |
| 3,233,580 | 2/1966 | Levake | 239/223 X |

*Primary Examiner*—Richard A. Schacher

*Attorney, Agent, or Firm*—Schuyler, Birch, McKie & Beckett

[57] ABSTRACT

A rotary atomizer suitable for spraying crops with liquid is driven by the liquid itself. The atomizer comprises a hollow, truncated cone, a central axial shaft extending through the interior of the cone, a liquid jet driven turbine on the shaft, and an opening in the turbine so that liquid flows from the turbine to the interior of the cone.

The liquid may be used at pressure of 0.7 to 10 bars gauge and feed rates of 10 to 1,000 ml/min, with the rate of feed being equal to the rate of discharge so that there is no liquid recycle.

7 Claims, 2 Drawing Figures

TURBINE DRIVEN ROTARY ATOMIZER AND METHOD OF USE

Figure 1:
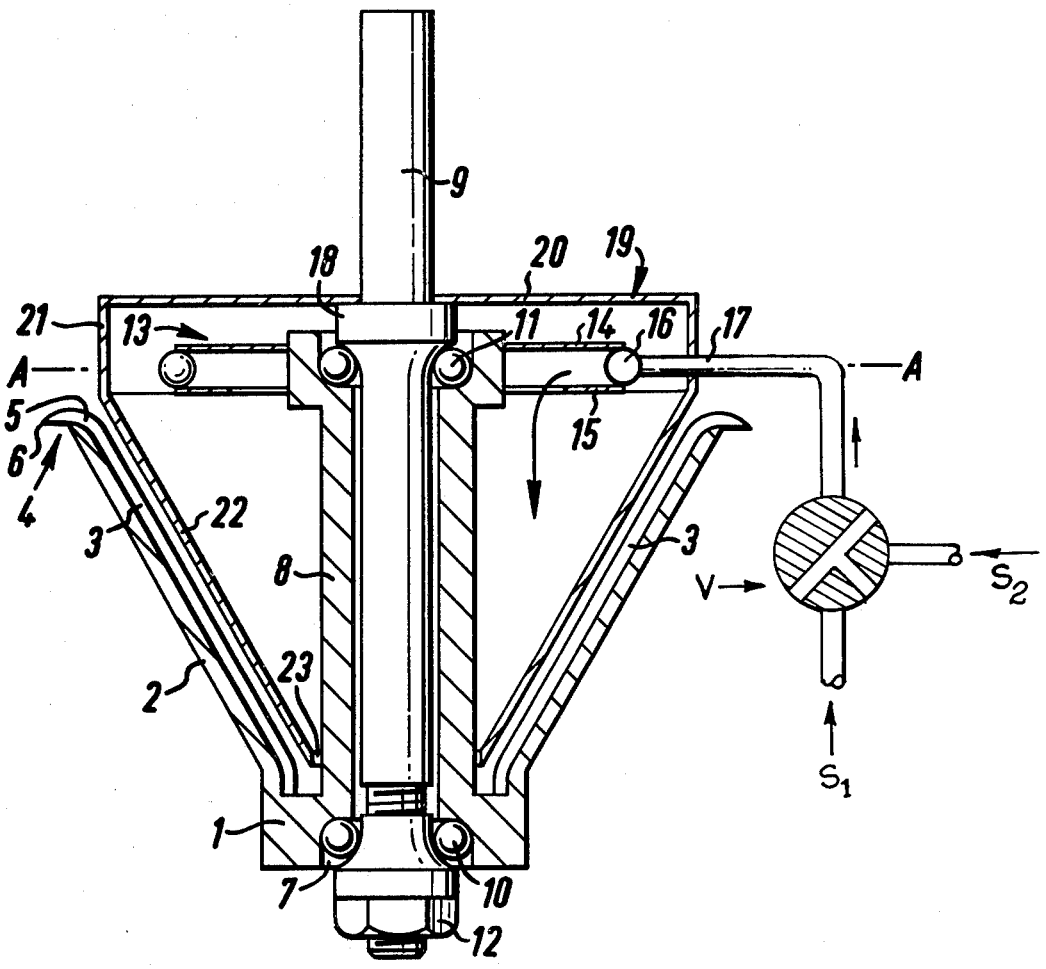

This invention relates to rotary atomisers, and has particular, though not exclusive, application to crop-spraying equipment.

Liquid sprays are applied to crops and agricultural land for a variety of reasons, but a principal use is for the application of pesticides, which may be herbicides, insecticides or fungicides. For efficient use of these relatively costly materials it is important that the droplets in the spray are of a size suitable for the application (usually between 20 and 500 microns diameter). Ideally the droplets should be of a completely uniform size, and the nearer this ideal can be approached the better.

Conventional pressure atomisers are not capable of giving uniform size droplets, so rotary atomisers are preferred, e.g., discs or hollow cones. Liquid is fed to the center of the atomiser, and rotation results in migration of the liquid to the periphery and discharge as a spray of droplets. The atomiser may have a serrated perimeter so that the liquid is discharged at a series of points of small dimensions, and it may have radial grooves to feed the liquid to these points. Such a design is based on the observation that the best results in terms of droplet size and uniformity of size, are obtained if the liquid issues as discrete filaments which are broken up into droplets after leaving the atomiser.

To give effective atomisation, the atomiser is rotated at fairly high speed, e.g., from 1,000 to 20,000 r.p.m. Belts, gearing or any other means of transmission may be used to drive the atomiser, although it is normally directly driven from an electric motor which may be battery powered in the case of hand-held sprayers. With larger vehicle or aircraft-mounted sprayers the drive may be indirectly from the propulsion unit using one or other of the auxiliary systems of the vehicle or aircraft. With small units liquid may be fed to the atomiser under gravity from a suitable container, but with larger units the liquid may be supplied under pressure from a pump.

The present invention uses the liquid feed to drive the atomiser by having a liquid driven turbine integral with the atomiser.

According to the present invention a rotary atomiser comprising a hollow, truncated cone is characterized in that it has a central axial shaft extending from the base of the cone through the interior of the cone, and a liquid jet driven turbine on the axial shaft, the turbine having an opening on the side nearest the cone so that liquid can flow from the turbine into the interior of the cone.

The invention is based on the discovery that the amount of liquid fed to and discharged from an atomiser as a spray is adequate to supply the sole motive power for rotating the atomiser provided the liquid is directed onto a turbine integral with the atomiser at a suitable liquid pressure and jet size. Preferably, therefore, there is no excess of liquid over and above that discharged from the atomiser and hence no need for the complication of recycling excess liquid back to the reservoir holding the liquid.

The present invention includes a method of spraying using a rotary atomiser as described above characterized in that liquid is fed to the jet and discharged from the cone in substantially equal amounts, there being no recycle of liquid.

The turbine may be a Pelton wheel. Such wheels are well known and comprise two circular plates having curved vanes between them arranged around the periphery of the cylinder so formed. The edge of the cylinder is open so that liquid can be directed onto the vanes by one or more jets placed tangentially around the cylinder. The circular plate farthest from the cone is solid to prevent escape of liquid in that direction but the other plate is annular so that, as previously indicated, liquid can escape from the center of the wheel and drop into the interior of the cone.

The number of jets may be from 1 to 6 depending on the liquid feed rate and speed of rotation required. For simplicity and convenience a single jet is preferred. The jet or jets may be supplied with liquid at a pressure of from 0.7 to 10 bars gauge. The diameter of the jet orifice will depend on the amount of liquid to be discharged from the atomiser but will normally be from 0.1 to 5 mm. In general it has been found that the jet orifice may be of a size to give liquid feed rates of from 10 to 1,000 ml/min for cones of from 2 to 10 inches overall diameter. It has also been found that speeds of rotation of from 500 to 20,000 rpm may be achieved within the above mentioned ranges of pressure and feed rate.

The hollow truncated cone preferably has a serrated perimeter, with radial grooves on the interior surface of the cone, so that separate, discrete, streams of liquid are fed from the center of the cone to the apex of the teeth formed by the serrated perimeter. The toothed perimeter is preferably in the form of a turned-over lip at right angles to the axis of the cone. Conical grooved atomisers are described and claimed in my U.K. Pat. No. 1515511 and in my U.K. Pat. Application No. 38250/77.

A non-rotating guard is preferably placed between the turbine and the interior surface of the cone to direct liquid from the turbine to the base of the cone and prevent it falling directly onto the conical interior surface. The guard may itself be a hollow truncated cone.

The central axial shaft of the atomiser may be hollow, and the atomiser may be mounted on a stationary spindle running through the shaft, there being suitable bearings between the spindle and the atomiser. The stationary spindle may also support the non-rotating guard described above.

The liquid feed for the atomiser may be contained in any suitable reservoir or pressurized tank which may, if desired, be separate from the atomiser unit. In the case of the reservoir, there may be a suitable pump in the line from the reservoir to the turbine jet. This pump can be driven by any suitable means depending on the type and size of sprayer. The line from the reservoir to the jet also has a valve, which may be a simple on-off valve or, preferably, a three-way valve. With a three-way valve the third position can be used to supply an alternative liquid for cleaning the atomiser and displacing any residual liquid on it after shut down. The type of cleaning liquid will depend on the type of liquid being sprayed and may be water, with or without detergent, or a hydrocarbon solvent.

Figure 2:
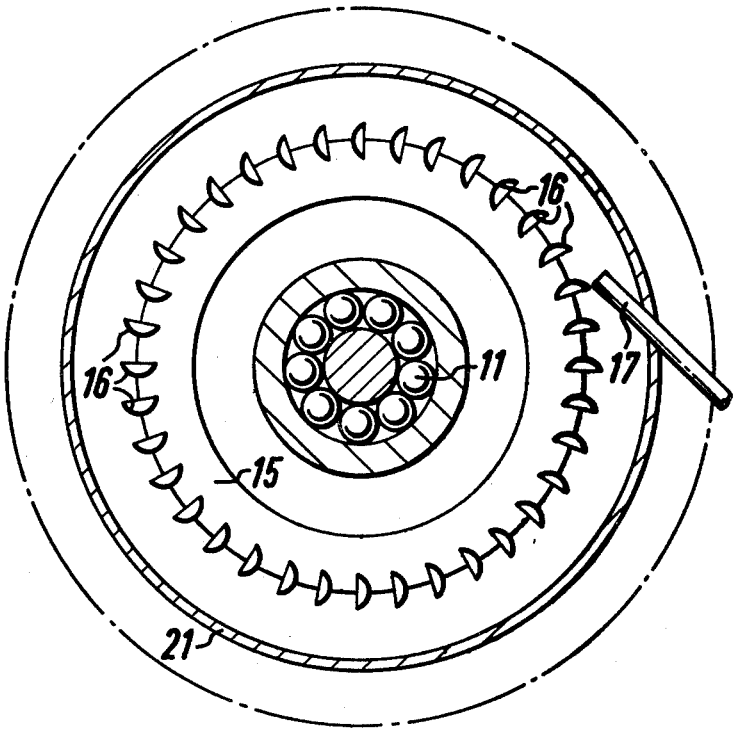

The invention is illustrated with reference to the accompanying drawings in which FIG. 1 is a section through a turbine driven atomiser according to the present invention, and FIG. 2 is a section along the line A—A of FIG. 1.

In the drawings a hollow truncated cone has a flat base 1 and a skirt 2 inclined at an angle of 60° to the axis of the cone. On the inside of the skirt are radial grooves 3, there being 180 grooves in all. The top of the skirt is turned over to form a lip 4 at right angles to the central axis of the cone, and the inner surface of the cone has a smooth rounded contour 5 where the angle changes. The lip is serrated to give 180 teeth 6 having an asymmetric shape. One side of each tooth is radial to the central axis of the cone, and the other side of each tooth is disposed at an angle to the axis. The top of each groove 3 is of the same width and contour as the gap between the teeth to give a smooth feed-way for liquid along each groove to each tooth.

The flat base 1 has a hollow portion 7, and a hollow central shaft 8 extends upwardly from the base. A spindle 9 extends through the central shaft 8 and the base 1 of the cone, and there are cup and cone bearings 10, 11 within the hollow portion 7 of the base and the top of central shaft 8. Nut 12 at the bottom of the spindle 9 holds the cone and shaft on the spindle.

At the top of shaft 8 is a Pelton wheel 13 formed of a circular top plate 14, an annular bottom plate 15 and vanes 16. A liquid feed pipe 17 is positioned close to the wheel and is tangential to it. Feed pipe 17 is connected to a source of liquid to be sprayed, $S_1$, via a three-way valve V. An alternative liquid, such as a cleaning solution, may be fed to the atomizer through valve V from source $S_2$.

A shoulder 18 on spindle 9 supports a guard 19 having a flat top 20, a cylindrical portion 21 through which feed pipe 17 passes and a conical portion 22 at the same 60° angle as the skirt 2. There is an annular gap 23 between the foot of portion 22 of the guard and central shaft 8.

In operation liquid is directed through pipe 17 onto vanes 16 of the Pelton wheel 13 causing the wheel to rotate on bearings 10, 11 around the stationary spindle 9. Liquid from the turbine drops under gravity from the inside of the wheel 13 through the center of the annular bottom plate 15 (as shown by the arrow) and onto the conical portion 22 of the stationary guard 19. The liquid then flows through gap 23 to the base 1 of the cone. Centrifugal force draws the liquid along grooves 3 as separate discrete streams of liquid to the lip 5 and teeth 6. The direction of rotation of the cone is such that the radial edge of each tooth 6 is the leading edge, and this encourages the liquid streams from grooves 3 to pass smoothly and evenly to each tip. The streams are discharged from each tooth as separate discrete filaments of uniform diameter, which break up, in the surrounding air into uniform, small size droplets.

I claim:

1. A rotary atomiser comprising a hollow truncated cone characterized in that it has a central axial shaft extending from the base of the cone through the interior of the cone, and a liquid jet driven turbine on the axial shaft, the turbine having an opening on the side nearest the cone so that liquid can flow from the turbine into the interior of the cone.

2. A rotary atomiser as claimed in claim 1 characterized in that the liquid jet driven turbine is a Pelton wheel.

3. A rotary atomiser as claimed in claim 1 characterized in that the liquid jet driven turbine has from 1 to 6 jets.

4. A rotary atomiser as claimed in claim 1 characterized in that a non-rotating guard is placed between the turbine and the interior surface of the cone to direct liquid from the turbine to the base of the cone.

5. A rotary atomiser as claimed in claim 1 characterized in that the liquid system to supply the jet of the turbine contains a three-way valve.

6. A method of spraying using a rotary atomiser as claimed in claim 1 characterized in that liquid is fed to the jet and discharged from the cone in substantially equal amounts, there being no recycle of liquid.

7. A method of spraying as claimed in claim 6 characterized in that the liquid pressure is from 0.7 to 10 bars gauge, and the liquid feed rate is from 10 to 1,000 ml/min.

* * * * *